US005525079A

United States Patent [19]

Johnson

[11] Patent Number: 5,525,079

[45] Date of Patent: Jun. 11, 1996

[54] FIELD INTERCONNECT TERMINAL ASSEMBLY MOUNTED ON PIVOTED ARM AND WIRE DUCT

[76] Inventor: Steve Johnson, 319 Glenridge Rd., Perry, Fla. 32347

[21] Appl. No.: 272,003

[22] Filed: Jul. 8, 1994

[51] Int. Cl.[6] ..... H01R 9/22

[52] U.S. Cl. ..... 439/709; 439/92

[58] Field of Search ..... 439/709, 712, 439/713, 714–719, 98, 108, 92, 95

[56] References Cited

U.S. PATENT DOCUMENTS

| | | | |
|---|---|---|---|
| 3,508,257 | 4/1970 | Grogan, Jr. | 439/716 |
| 3,745,546 | 7/1973 | Struger et al. | 340/250 |
| 3,992,654 | 11/1976 | Springer et al. | 317/101 DA |
| 4,151,580 | 4/1979 | Struger et al. | 361/415 |
| 4,686,381 | 8/1987 | Boteler et al. | 307/147 |
| 4,753,610 | 6/1988 | Eason et al. | 439/713 |
| 4,775,324 | 10/1988 | Norden | 489/709 |
| 4,861,287 | 8/1989 | Bevacqua et al. | 439/718 |
| 4,924,213 | 5/1990 | Decho et al. | 340/563 |
| 4,938,715 | 7/1990 | Jones et al. | 439/621 |
| 5,043,847 | 8/1991 | Deinhardt et al. | 361/395 |
| 5,249,979 | 10/1993 | Deinhaudt et al. | 439/716 |
| 5,253,140 | 10/1993 | Inoue et al. | 361/728 |

*Primary Examiner*– Hien D. Vu

*Attorney, Agent, or Firm*– Jagtiani & Associates; Ajay A. Jagtiani

[57] ABSTRACT

According to the present invention, there is provided a wire terminal and assembly. The wire terminal and assembly comprises a wire way which is connected to a pivot support plate. An assembly hinge plate is provided with a hinge which in turn is clipped onto the hinge with a clip. A DIN rail is attached to the assembly hinge plate and an upright support plate is connected to the wire way. A terminal block is removably attached to the DIN rail. Primary and secondary terminals are connected to the terminal block. It should be appreciated that the terminal block has a base member which is integrally connected to a wire guide and a terminal component housing. Finally, it should be appreciated that the wire guide and terminal component housing is provided with a space therebetween, the wire way provides a housing for wire.

7 Claims, 4 Drawing Sheets

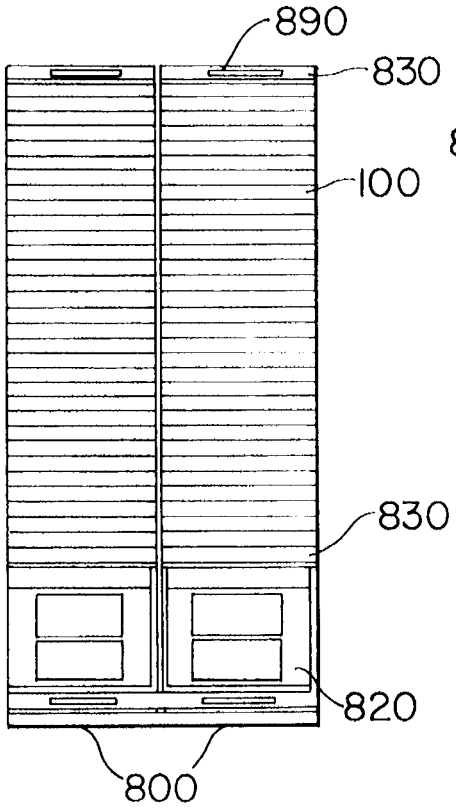
FIG. 3
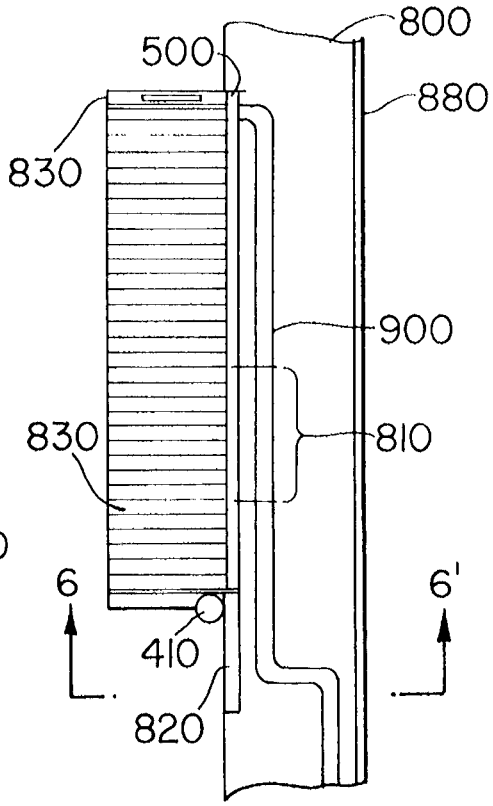
FIG. 4
FIG. 6
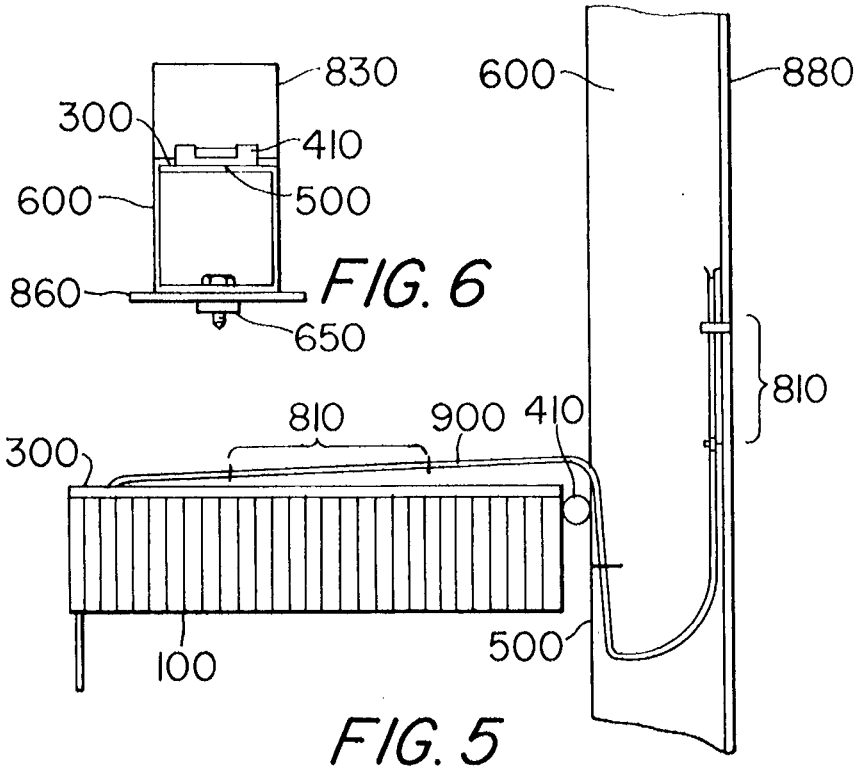
FIG. 5

FIELD INTERCONNECT TERMINAL ASSEMBLY MOUNTED ON PIVOTED ARM AND WIRE DUCT

BACKGROUND OF THE INVENTION

Field of the Invention

The present invention relates generally to terminal block connections, and more particularly to field interconnection panels used to interface between control equipment such as valves, switches, motors, programmable logic controllers and digital computer equipment.

Description of the Prior Art

A field interconnection panel normally contains rows or columns of wire terminals, wire duct and wire access space between terminals and wire ducts for purposes of manipulation of wires and visual identification of wire markings. The wire way or duct is usually to the side or around the terminal block or gang of blocks. Wires inserted from the side of the terminal block increases space needs and usually becomes cluttered. The job of making new connections and removing old connections may become cumbersome and very difficult.

Field devices are wired directly to input/output (I/O) circuits, boards or in some cases to pivoted terminal blocks. Pivoted terminal blocks may be connected directly into a circuit board to allow external connections to be made on the terminal block. With the advent of miniaturization, the space available for technicians and engineers to work on wiring of terminal blocks has been reduced. Unfortunately, easy access to backs of these terminal blocks is not available. Another disadvantage of terminal blocks connected directly into a circuit board is that the terminal blocks do not allow the engineer to add necessary accessories such as fuses, knife switches, light emitting diodes LED's, or other trouble shooting and circuit protection devices.

A number of attempts have been made to resolve these problems. For example, U.S. Pat. No. 4,151,580, issued to Struger et al., discloses a number of wire terminals provided on a swing arm. The back of the wire terminals interconnect with an edge card of a circuit board. The terminals are then used to wire the edge card to various external devices. Finally, a locking device is used to lock the terminal block in an upward position and engage the edge connector. U.S. Pat. No. 5,243,140, issued to Inoue et al., and U.S. Pat. No. 5,043,847, issued to Deiahardt et al., disclose other examples of pivoting terminal mountings, such as disclosed in Struger et al. These patents fail to address the problems of wiring a terminal block from the side/backside and allowing the terminal block to pivot away from the wire way in a non-stressing manner. Finally, these patents fail to allow ease of access to both the wires and the backs and fronts of the terminal blocks.

U.S. Pat. No. 3,992,654, issued to Springer et al., discloses a terminal block and wire way which is integrally connected. Wires attached to the terminal block are routed through a pivoting hollow joint. The wire way and terminal block pivot as one unit. The back of the terminal block interconnects with a circuit board within a box. This structure has the disadvantage of stressing the wires whenever a technician or engineer opens or closes the terminal box. This stressing may result in damage to the wires and eventual failure of the electrical connection.

SUMMARY OF THE INVENTION

It is therefore an object of the present invention to provide a dual wire terminal assembly including a new "boot" shaped main wire terminal which attaches to a DIN mounting rail. A second terminal assembly is connected to a terminal blocks and is connected through metal connectors. This second terminal has individual screw terminal posts for connecting to input/output (I/O) circuit boards. Both terminal assemblies are connected to a pivoting base which the mounting rail is a part of. The above assembly is mounted on a rigid 3-sided wire duct. When the pivoting assembly is pulled down, the secondary terminal assembly and the wires connected from the terminal assembly to the I/O devices or I/O circuit board is exposed.

There are three main parts of an interconnection panel: the wire terminal, the wire duct to provide a wire path to the I/O circuit board or external devices and the space between the wire duct and terminal for installation, maintenance and identification. The general purpose of this invention is to combine all three parts into one modular unit, thereby saving substantial space.

It is therefore an object of the present invention to provide a terminal block and wire way which will provide an improved terminal and wire way assembly.

It is a further object to provide adequate space in the main terminal for accessories such as fuses, blown fuse indicators (neon or light emitting diodes LED), resistors and other electronic devices.

It is yet another object to provide access to the secondary terminal and wire way by unlatching the terminal assembly and by swinging the arm of the terminal assembly down on a pivot of adequate strength.

It is yet another object to provide a means to mount the terminal assembly on a wire duct which is rigid enough to support the assembly.

It is yet another object to provide a ground path from the main terminal mounting rail to the cabinet panel.

In all of the above embodiments, it is an object to provide improved space for wiring.

Finally, it is an object of the invention to provide a field interconnect terminal assembly on a pivoting arm and wire duct.

According to one broad aspect of the present invention there is provided a wire way, the wire way is connected to a pivot support plate. An assembly hinge plate is provided with a hinge, the pivot support plate is clipped onto said hinge with a clip; a DIN rail is attached to the assembly hinge plate; an upright support plate is connected to the wire way; a terminal block is removably attached to the DIN rail; a primary terminal is connected to the terminal block; a secondary terminal connected to said terminal block; the terminal block having a base member, the base member integrally connected to a wire guide; the base member integrally connected to a terminal component housing; the wire guide and terminal component housing provided with a space therebetween; and the wire way providing a housing for wire.

Other objects and features of the present invention will be apparent from the following detailed description of the preferred embodiment.

BRIEF DESCRIPTION OF THE DRAWINGS

The invention will be further described in conjunction with the accompanying drawings, in which:

FIG. 3 is a front view of the boot terminal assembly and wire way;

FIG. 4 is a side view of the terminal block assembly with the terminal block assembly in the locked and upward position;

FIG. 5 is a side view of the a terminal-block assembly in the unlocked and pulled down position;

FIG. 6 is a cross sectional view cut along section A—A of FIG. 4, showing a pivot support plate, hinge and related parts.

DETAILED DESCRIPTION OF THE PREFERRED EMBODIMENT

Figure 1:
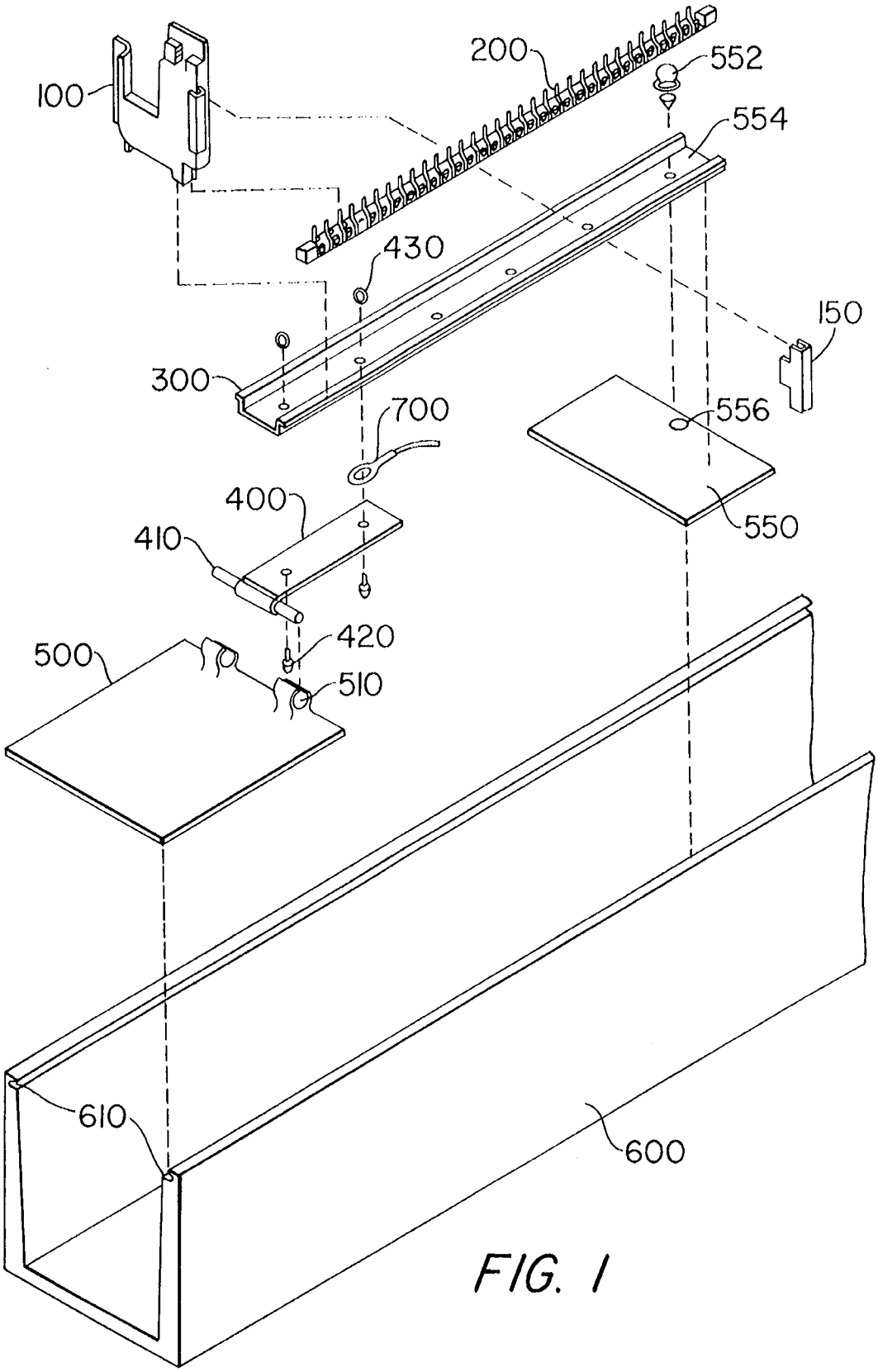
FIG. 1 is an exploded view of a terminal block and wiring system in accordance with a preferred embodiment of the invention.

With reference to the figures, wherein like reference characters indicate like elements throughout the several views and, in particular, with reference to FIG. 1, terminal block 100 connects to a DIN rail 300 and a secondary terminal strip 200. The secondary terminal strip may be secured to a support (not shown). An assembly hinge plate 400 is connected at one end of DIN rail 300. Securing of DIN rail and assembly hinge plate 400 is accomplished by use of bolt and nuts 420 and 430, respectively. A ground wire 700 is connected between DIN rail 300 and assembly hinge plate 400. Securing means 420 and 430 may be used to provide a solid connection for ground wire 700 to both assembly hinge plate 400 and DIN rail 300. In a preferred embodiment, assembly hinge plate 400 and DIN rail 300 are constructed of metal.

A hinge pin 410 is provided at one end of assembly hinge plate 400. Hinge pin 410 is snapped into retaining clips 510 to provide a secured and flexible pivot point. In a preferred embodiment, retaining clips 510 are formed as part of pivot support plate 500.

Pivot support plate 500 is inserted into a wire way 600 having channels 610. An upright support plate 550 is also inserted into channels 610 and attached to an end of DIN rail 300 distal from where DIN rail 300 is attached to pivot support plate 500. The pivot support plate 500 provides support to DIN rail 300 and related terminal-block block 100 and allows for pivoting of terminal block 100 inward and outward from wire way 600. Upright support plate 550 supports and stops DIN rail 300 from passing into the wire way 600.

Wire way 600 is a 3-sided molded piece of plastic having sufficient rigidity to support terminal block 100. The sides of wire way 600 are of sufficient flexibility to allow pivot support plate 500 and upright support plate 550 to snap into place and maintain their position after initial insertion. The top ends of wire way 600 is notched to form channels 610 so as to receive and retain pivot support plate 500 and upright support plate 550.

Pivot support plate 500 and upright support plate 550 are formed of molded plastic having notched edges. The notched edges help retain pivot support plate 500 and upright support plate 550 in a snapped and secured position in wire way notches 610. Retaining clips 510 are integrally formed during the manufacturing of the molded plastic pivot support plate 500. A receiving appature 556 is formed in the upright support plate 550 during the molding process.

DIN rail 300 is an industry standard device. A pre-drilled hole 554 receives a removable locking pin 552. The locking pin 552 is inserted through DIN rail 300 and into receiving appature 556 in plastic upright support plate 550. Pin 552 holds DIN rail 300 upright against upright support plate 550. Alternately a clamping device may be formed at the top of upright support member 550 during molding such that the clamping device would secure to DIN rail 300.

Figure 2A:
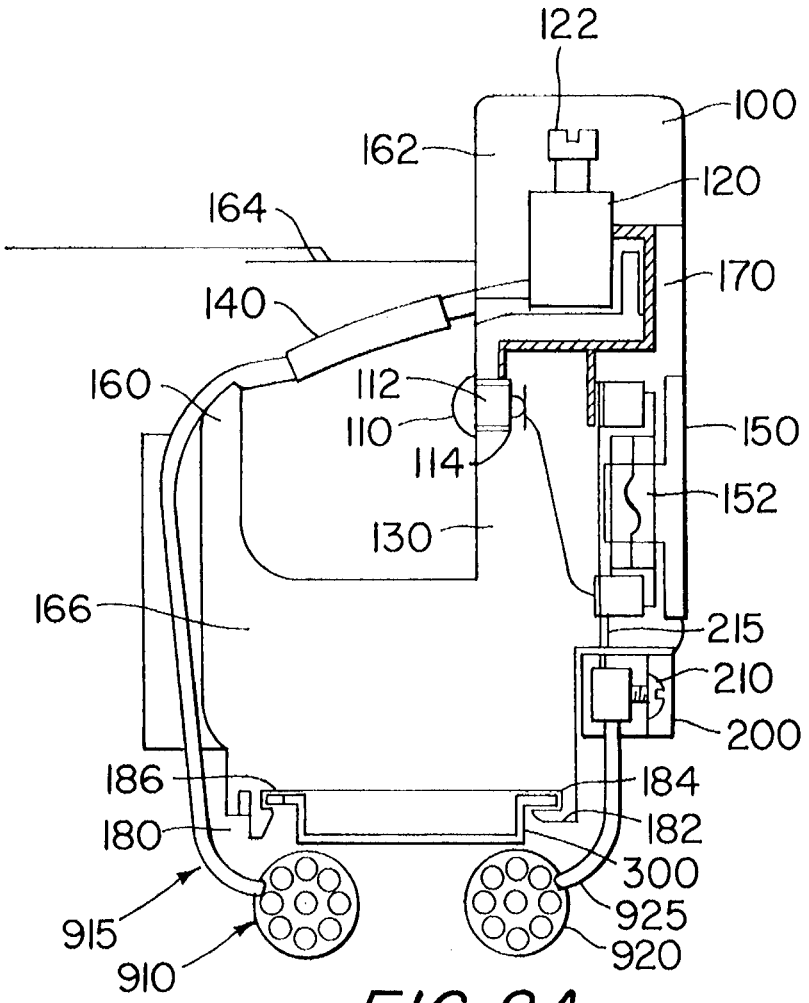
FIG. 2A is a side view of a terminal block of FIG. 1; and the related components therefore.

Turning know to FIG. 2A, terminal-block 100 is shown connected on DIN rail 300 and secondary terminal strip 200. Terminal-block 100 comprises a base member 166, wire guide 160 and terminal component housing 162. A space 164 is provided between wire guide 160 and terminal component housing 162. Space 164 provides a technician or engineer needed space to provide hook-up of wire 915 to primary terminal 120. Indicia 140 and light indicator 110 are easily visible to a technician or engineer that is wiring, rewiring or inspecting terminal-block 100. Wire guide 160 is provided with a curved surface to prevent crimping of a wire attached to the terminal component housing. The size of terminal blocks 100 are relatively small in dimension. Therefore, space 164 needs to be large enough to allow visibility, yet small enough to allow the terminal block dimensions to be within the industry standard. Terminal block 100 connects to a standard DIN rail 300.

A base member 166 engages DIN rail 300 by sliding an L member 182 onto rail 184. A clip 180 is then pressed into place thereby latching onto rail 186. This press action locks terminal-100 into position on DIN rail 300. The technician passes wire 915 along wire guide 160 across open space 164 and into primary terminal 120. Wire guide 160 is curved to avoid crimping of wire 915. Wire 915 is then secured to terminal 120 with a screw 122. Secondary terminal strip 200 abuts wire connector 215 to make electrical contact. Wire 925 is connected to secondary terminal strip 200 with screw 210. Wires 915 and 925 are pulled from bundles of tie wrapped wires 910 and 920. Other wires in each bundle 910 and 920 may be attached to other terminal blocks 100 secured to the same or different DIN rails 300.

Terminal 120 connects to a current bar 170. Current bar 170 provides electrical connection between an anode 112 of light 110 and a first end of fuse 152. A cathode 114 of light 130 may be electrically connected to wire 130. The wire 130 electrically connects the second end off use 152 to cathode 114 of light 130. The second end of fuse 152 is connected to a connector 215. Secondary terminal 200 is in electrical contact with connector 215, thereby providing a connection from wire 925 to fuse 152. Fuse 152 is provided with a fuse puller 150 for allowing a technician to easily remove fuse 152.

Figure 2B:
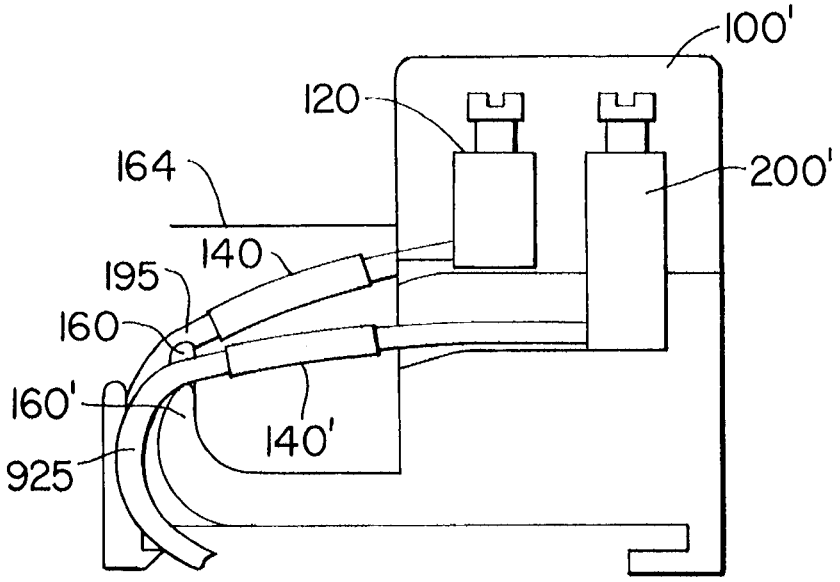
FIG. 2B is a side view of an alternate embodiment of the terminal block of FIG. 1.

An alternate embodiment, shown in FIG. 2B, is to make secondary terminal 200 integral with individual terminal-blocks 100. Secondary terminal 200' would replace secondary terminal strip 200 with a terminal similar to primary terminal 120. Wire 925 would then be passed over wire guide 160', instead of connected to the underside of terminal block 100. The intemal circuitry is not shown for clarity of exterior wiring and relative locations on terminal block 100'. Wire 925 is provided with indicia 140'. Various terminal blocks providing knife switches, dedicated fuses, or other trouble shooting and circuit protection devices may be used. The LED/FUSE and basic terminal connection blocks have been shown.

Turning now to the terminal assembly cabinet 800, shown in FIG. 3, the terminal assembly is fully assembled and in a locked position. Cabinet 800 is constructed with a locking means 840 at the top most of a rack or gang of terminal blocks 100. Locking means 840 holds a gang of terminal blocks 100 in a upright position thereby preventing the gang of terminal blocks 100 connected to hinged DIN rail 300 from pivoting away from wire ways 600 and cabinet 800. Locking means 840 may be a clip type, tie-down, or other conventional locking device. Further, locking means 840 may be constructed to work with or as a removable locking pin 552 as shown in FIG. 1. Two sets of anchors 830 are provided at the bottom and top of the gang of terminal blocks 300. Anchors 830 may also be located in-between various terminal blocks 100 to provide spacing and added mechanical structure to the gang of terminal blocks 100. Space for nametags 820 is provided to identify to the engineer or technician what the equipment the gang of terminal-block blocks 100 pertain to.

Cabinet 800 is designed to hold the gang of terminal blocks 100. A back panel 880 is shown, side panels have not been shown for clarity. Wire bundle 900 contains smaller wire bundles 910 and 920 which pass through wire way 600 to be connected to terminal-block block 100. A securing means 810 is provided on back panel 880 of cabinet 800 and wire way 600. Retaining means 810 is used to hold wire bundle 900 away from the backs of gangs of terminal blocks 100. Retaining means 810 may be formed integrally during the construction of wire way 600.

FIG. 6 is a cross sectional view of FIG. 4 with wire bundle 900 removed for clarity. Wire way 600 is attached to back panel 880 of cabinet 800 with a securing means 650. A screw and nut 650 are shown as being exemplary of one type of securing means 650 which may be utilized. It should be appreciated that other securing means may be easily adapted to work in place of a screw and nut 650. Pivot support plate 500 and hinge 410 are shown attached to both wire way 600 and DIN rail 300. An end anchor 830 is attached to DIN rail 300.

When in a down position, as shown in FIG. 5, the gang of terminals 100 allows easy access for technicians and engineers for wiring an individual terminal block 100. Wire bundle 900 is shown running from the top of cabinet 800, as opposed to from the bottom as is shown in FIG. 4. The direction of origin for wire bundle 900 is not limited. Retaining means 810 holds wire bundle 900 away from the front of cabinet 800 and to the back of wire ways 600. Wire bundle 900 is allowed ample slack and spacing so that no binding or stress points occur. Bundle 900 is split at the individual terminal block 100 to which it is wired. Terminal blocks 100 are added and removed from DIN rail 300 as needed by technicians. Terminal blocks 100 providing different trouble shooting and circuit protection devices may be used on the same DIN rail 300, thereby giving greater flexibility to the technician or engineer. Further, many wire ways 600 may be attached within a single cabinet 800. Cabinet 800, in some commercial sites may not be needed. When a cabinet is not needed, a back panel 880 may be used separate from a cabinet structure 800.

Figure 7:
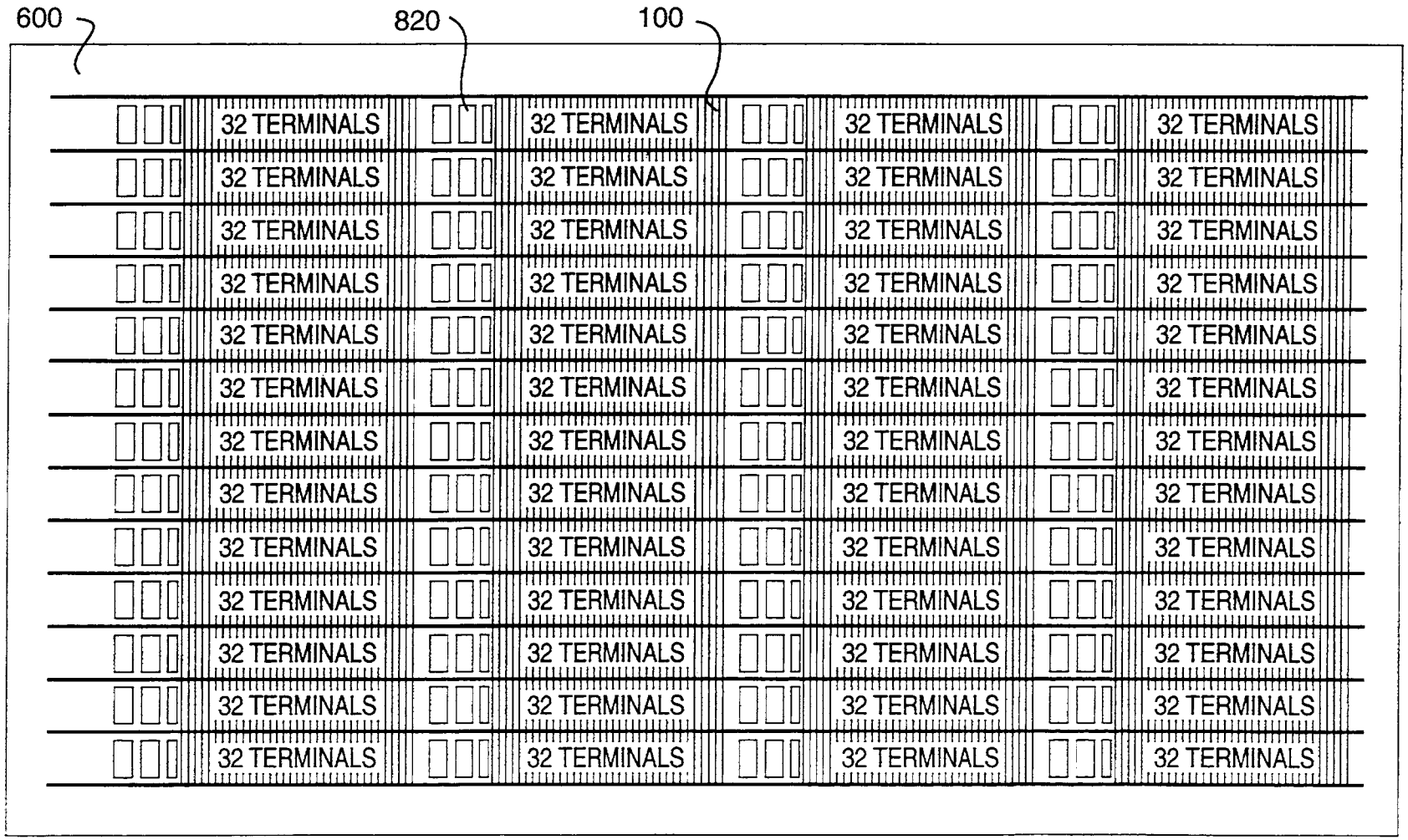
FIG. 7 is a front view of a gang of terminal blocks in related positions and sizes.

FIG. 7, shows 1664 terminals provided in a 72"×36" panel section. The relative dimensions are shown to provide spatial relationships. This is a substantial improvement over prior art wire way and terminal block devices.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A wire terminal and assembly comprising:

a wire way, said wire way connected to a pivot support plate an assembly hinge plate provided with a hinge, said pivot support plate clipped onto said onto said hinge with a clip;

said assembly hinge plate attached to a DIN rail;

an upright support plate connected to said wire way;

at least one terminal block removably attached to said DIN rail;

a primary terminal connected to said terminal block;

a secondary terminal connected to said terminal block;

said terminal block having a base member, a wire guide and a terminal component housing, wherein said wire guide is extended from a first end of said base member and said terminal component housing is extended from a second end of said base member;

said wire guide and said terminal component housing provided with a space therebetween;

said wire way housing at least one wire;

a ground wire is connected between said DIN rail and said assembly hinge plate;

said DIN rail being pivotal about said hinge; and said upright support plate having a stopping portion for engaging with said wire way to prevent said DIN rail from pivotal movement.

2. The wire terminal and assembly recited in claim 1 wherein said terminal block is removably attached to said DIN rail by a clips.

3. A wire terminal and assembly recited in claim 1 wherein said upright support plate and said pivot support plate are molded of plastic.

4. A wire terminal and assembly recited in claim 1 wherein said wire way is molded of plastic.

5. A wire terminal and assembly recited in claim 1 wherein said secondary terminal is a terminal strip.

6. A wire terminal and assembly recited in claim 5 wherein said terminal strip is connected to an underside of said terminal block.

7. A wire terminal and assembly recited in claim 1 wherein said wire way is attached to a back panel.

* * * * *